US008368731B2

(12) United States Patent
Klenkler et al.

(10) Patent No.: US 8,368,731 B2
(45) Date of Patent: Feb. 5, 2013

(54) ELECTROSTATIC IMAGING MEMBER AND METHODS FOR USING THE SAME

(75) Inventors: Richard A. Klenkler, Oakville (CA); Gregory McGuire, Oakville (CA); Johann Junginger, Toronto (CA); Vladislav Skorokhod, Mississauga (CA); Robert Street, Palo Alto, CA (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 270 days.

(21) Appl. No.: 12/887,434

(22) Filed: Sep. 21, 2010

(65) Prior Publication Data

US 2012/0069122 A1 Mar. 22, 2012

(51) Int. Cl.
*B41J 2/00* (2006.01)

(52) U.S. Cl. ..... 347/151

(58) Field of Classification Search ..... 347/140, 347/141, 151

See application file for complete search history.

(56) References Cited

U.S. PATENT DOCUMENTS

| | | | | |
|---|---|---|---|---|
| 4,757,343 | A * | 7/1988 | Nakatani et al. | 347/142 |
| 5,215,839 | A | 6/1993 | Yu | |
| 5,660,961 | A | 8/1997 | Yu | |
| 5,958,638 | A | 9/1999 | Katayama et al. | |
| 6,043,830 | A * | 3/2000 | Zur et al. | 347/120 |
| 2011/0039201 | A1 * | 2/2011 | Law et al. | 430/124.1 |

OTHER PUBLICATIONS

U.S. Appl. No. 12/366,665, filed Feb. 6, 2009, McGuire et al.
U.S. Appl. No. 12/366,680, filed Feb. 6, 2009, Skorokhod et al.

* cited by examiner

*Primary Examiner* — Stephen Meier
*Assistant Examiner* — Tracey McMillion
(74) *Attorney, Agent, or Firm* — Pillsbury Winthrop Shaw Pittman LLP

(57) ABSTRACT

Embodiments pertain to a novel imaging member, namely, an electrostatic latent image generating member, and methods for using the same, that can generate an electrostatic latent image digitally with fewer steps and without using a raster output scanner (ROS) or free charge carriers. Embodiments provide a novel way of generating an electrostatic latent image without the shortfalls suffered by current photoreceptors, such as for example, charge mobility issues, unstable cycling, surface wear, lateral charge migration and sensitivity to light shock.

19 Claims, 4 Drawing Sheets

ELECTROSTATIC IMAGING MEMBER AND METHODS FOR USING THE SAME

BACKGROUND

The presently disclosed embodiments pertain to a novel imaging member, namely, an electrostatic latent image generating member that can generate an electrostatic latent image digitally through a single step charging process. The embodiments provide a novel way of generating an electrostatic latent image without the shortfalls suffered by current photoreceptors, such as for example, charge mobility issues, unstable cycling, surface wear, lateral charge migration and sensitivity to light shock.

In conventional electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

Thus, it can be seen that current xerographic printing involves multiple steps, such as, charging the photoreceptor; developing the latent images, transferring and fusing the developed images; and, erasing and cleaning the photoreceptor. These multiple steps require many electromechanical components, which leads to more opportunities for system breakdowns or failures. Future trends in the industry are focusing on using machines that are smaller, faster, smarter, less costly and environmentally friendly. Thus, there is a need to re-design engine architecture to achieve machines that use fewer steps and fewer individual components such as for example, a printing apparatus that can create the latent image in a single step during charging, whereby the ROS is no longer needed.

The present embodiments provide an imaging member that allows for the latent image to be created during the charging process. The electrostatic imaging member comprises digitally addressable metallic pads arranged as pixels, sandwiched between a thin-film transistor (TFT) backplane and a thin dielectric surface layer, where each pixel pad can individually be selectively isolated or connected to ground through the transistor backplane. A latent electrostatic image can be created on the dielectric surface of the imaging member by selectively grounding the pixel pads in an imagewise fashion while exposing the dielectric surface of the device to a corona source, such as a corotron. The ionized corona gas will be selectively electrostatically attracted to the grounded pixels under the dielectric layer.

An additional benefit provided by the present embodiments is that the layer on the outer surface of the imaging member can be selected from a range of dielectric materials so as to minimize wear relative to traditional organic photoreceptors. This allows the present embodiments to extend the lifetime of the device.

U.S. patent Ser. No. 12/366,665 to McGuire et al., filed Feb. 6, 2009, and U.S. patent Ser. No. 12/366,680 to Skorokhod et al., filed Feb. 6, 2009, hereby incorporated by reference in their entirety, describe an apparatus for forming a latent image via scorotron charging coupled with TFT discharging or TFT photoreceptor addressing/discharging. However, these designs still require the use of charge carriers to selectively discharge the photoreceptor's surface to create the desired electrostatic image (i.e., the devices require the incorporation of charge transport compounds).

The present embodiments provide digitalization of the xerographic marking process in a manner that results in a smaller, smarter and more efficient machine.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule" or "electron transport molecules."

SUMMARY

According to aspects illustrated herein, there is provided a method for creating an electrostatic latent image, comprising providing an electrostatic imaging member, further comprising a support substrate having individually addressable pixel pads arranged on or in the support substrate, and a dielectric layer disposed over the individually addressable pixel pads, applying an electrostatic charger to the electrostatic imaging member, and generating an electrostatic image, wherein the electrostatic image is generated in a single step by grounding selected pixel pads in a pattern that is to be printed while applying the electrostatic charger to the surface of the dielectric layer of the electrostatic imaging member.

In another embodiment, there is provided an electrostatic imaging device, comprising an electrostatic imaging member comprising a support substrate having individually addressable pixel pads arranged on or in the support substrate, and a dielectric layer disposed over the individually addressable pixel pads, wherein the individually addressable pixel pads are patterned on the support substrate in an array, and an electrostatic charging device, wherein an electrostatic image is generated by grounding selected pixel pads in a pattern that is to be printed while applying the electrostatic charger to the surface of the dielectric layer of the electrostatic imaging member.

Yet another embodiment, there is provided an image forming apparatus for forming images on a recording medium comprising a) an electrostatic imaging device having a charge retentive-surface for receiving an electrostatic latent image thereon, wherein the electrostatic imaging device comprises an electrostatic imaging member comprising a support substrate having individually addressable pixel pads arranged on or in the support substrate, and a dielectric layer disposed over the individually addressable pixel pads, wherein the individually addressable pixel pads are patterned on the support substrate in an array, and an electrostatic charging device, wherein an electrostatic image is generated by grounding selected pixels pads in a pattern that is to be printed while applying the electrostatic charger to the surface of the dielectric layer of the electrostatic imaging member, b) a development component for applying a developer material to the charge-retentive surface to develop the electrostatic latent image to form a developed image on the charge-retentive surface, c) a transfer component for transferring the developed image from the charge-retentive surface to a copy substrate, and d) a fusing component for fusing the developed image to the copy substrate.

BRIEF DESCRIPTION OF THE DRAWINGS

For a better understanding, reference may be made to the accompanying figures.

DETAILED DESCRIPTION

In the following description, reference is made to the accompanying drawings, which form a part hereof and which illustrate several embodiments. It is understood that other embodiments may be used and structural and operational changes may be made without departure from the scope of the present disclosure.

There are several disadvantages of the photoreceptor-based xerographic process which include limited charge mobility (and therefore limited system response time and printing speed), unstable cycling, lateral charge migration, surface wear, sensitivity to light shock, and the need for an expensive light source (e.g., raster output scanner (ROS)) which occupies considerable space in the system and adds to the cost of the system. Additionally, exposure to a laser beam is associated with various parasitic effects that cause image distortion and limit image resolution. Several solutions to these issues have been proposed through the years but these have not been able to entirely resolve the issues.

The presently disclosed embodiments generally pertain to a novel imaging member that provides for digitalization of the xerographic marking process in a manner that requires far fewer steps and electromechanical components than conventional image-forming apparatuses. In particular, the present embodiments provide an electrostatic latent image generating member that can generate an electrostatic latent image digitally in a single step charging process and without using a ROS or free charge carriers. The latent image is created in a single step, wherein the surface is charged imagewise in the pattern that is to be printed. Because, the latent electrostatic image is created on the device during charging, it is no longer necessary to expose the image receptor to a pattern of light in the likeness of what is to be printed, e.g., via a ROS. It is also no longer necessary to include photogenerating pigment or charge transport molecules as there is no discharge of the surface potential in this invention.

Figure 1:
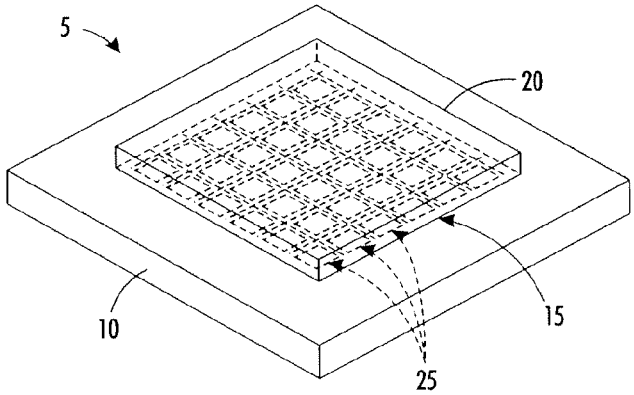
FIG. 1 is a cross-section of an electrostatic latent imaging member according to the present various embodiments.
Figure 2:
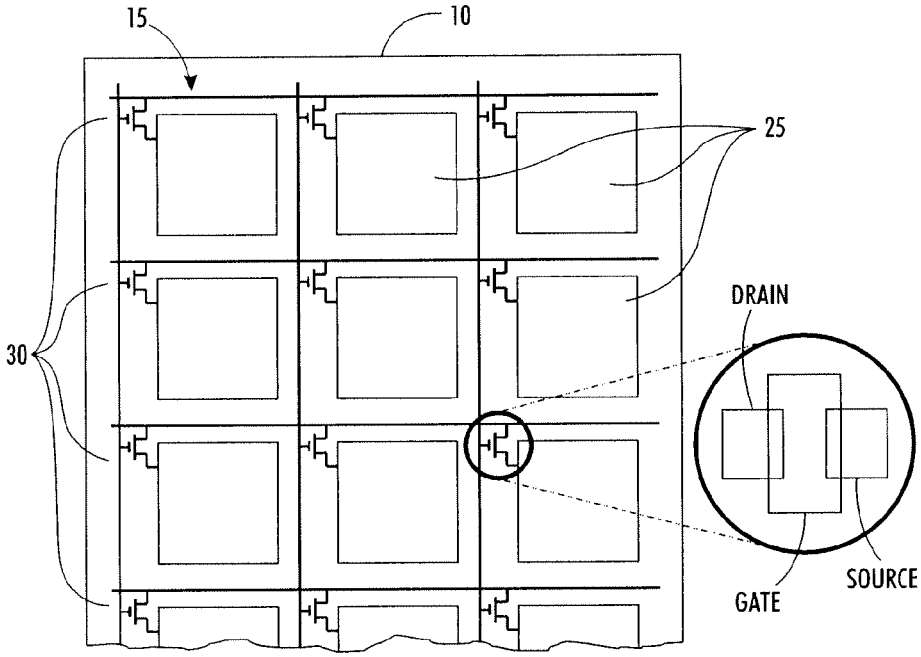
FIG. 2 is a top view of a portion of the exemplary electrostatic latent imaging member shown in FIG. 1 according to the present embodiments.
Figure 3:
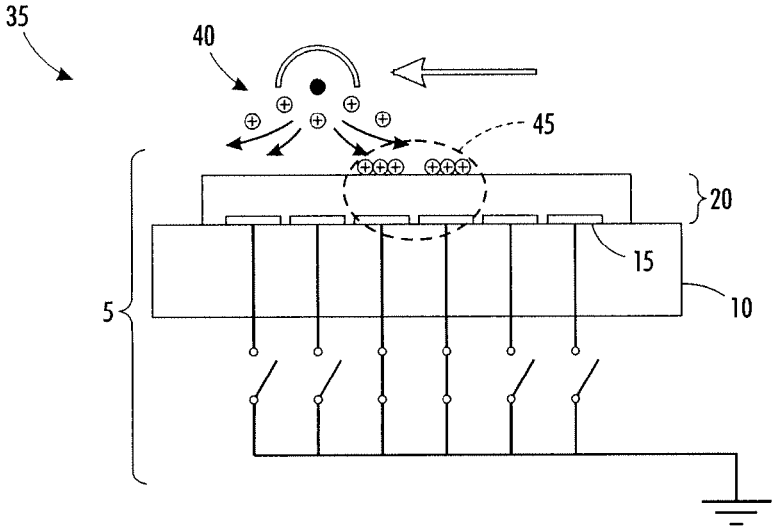
FIG. 3 is an alternative view of a cross-section of an electrostatic latent imaging member according to the present embodiments.

In embodiments, as shown in FIG. 1, the electrostatic imaging member 5 comprises a support substrate 10 having digitally addressable metal pixel pads 25 connected to transistors 30 that are in turn are connected with electrodes 15 to form a system of metal pixel pads addressed by a driving circuit, over which a dielectric layer 20 is disposed. The digitally addressable pixel pads 25 are micro-sized and patterned on the support substrate 10 in an array, where each pixel pad can be individually, selectively isolated or connected to ground through the transistor/electrode driving circuit. A latent electrostatic image can be created on the dielectric surface of the imaging member by selectively grounding the pixel pads in an imagewise fashion while exposing the dielectric surface of the device to an electrostatic charger such as a corotron, scorotron, or dielectric gap charger (e.g. biased charge roll). In this manner, ionized gas, either positively or negatively charged, will be selectively electrostatically attracted to the grounded pixel pads under the dielectric layer (FIG. 3). Thus, the desired electrostatic image can be created on the dielectric surface during the charging process. Namely, the electrostatic charge emitted by the charger is selectively attracted to the surface of the device in the region of the grounded pixels and hence, in the pattern of the image to be printed (as illustrated by FIG. 3). Following formation of the electrostatic image on the novel device, xerographic charge area development and transfer processes can be employed to print the image on a sheet of paper, or other substrate. From this point, the electrophotographic printing process can be continued in a conventional manner. For example, conventional charged area development of the latent electrostatic image with toner that is of opposite charge to the electrostatic image on the imaging member, followed by transfer and fusing of the toner on to the receiving paper.

Figure 4A:
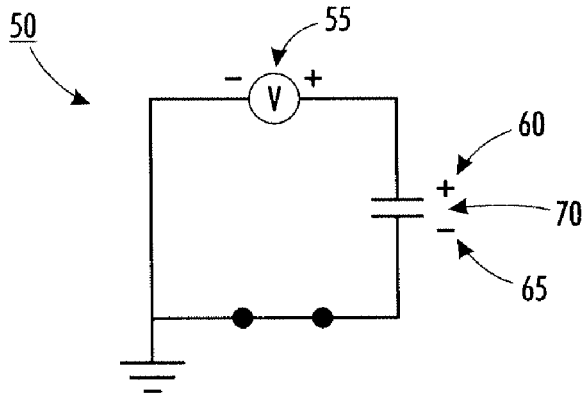
FIGS. 4A and 4B schematically illustrate an exemplary method of forming an electrostatic latent image according to the present embodiments.
Figure 4B:
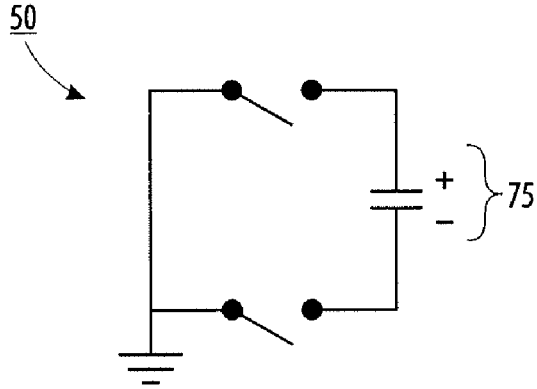

In FIGS. 4A and 4B, the attraction of the corona charge to the grounded pixels is illustrated. The attraction is analogous to the charging of a capacitor. In FIG. 4A, there is depicted a circuit 50 that is representative of what occurs when the voltage source 55, the corona charger, is immediately over an area of the imaging member with a grounded electrode. As shown, positive electronic charge (holes) on the electrode 60 is analogous to the positive corona ions on the surface of the imaging member, and the negative counter charge on the electrode 65 is analogous to the grounded pixel pad. The capacitor 70 is analogous to the dielectric layer on the imaging member. In FIG. 4B, there is depicted the circuit 50 that is representative of what occurs just as the corona charger is moved away from being immediately over the area of the imaging member with a grounded electrode 75. The positively charged corona ions are held in place, on the surface of the imaging member by the negative counter charge on the pixel pad, just as a capacitor holds charge when it is disconnected from a circuit.

Based on these principles, the driving circuit must selectively ground the appropriate pixel pads for the duration of time that the corotron charger passes over them, so that the desired electrostatic image can be created. Only after the corotron charger has passed over a pixel pad that is to be charged can the pixel be released from ground. Thus, the timing of the driving circuit, controlling the grounding of the pixel pads, and the motion of the corotron must be synchronized.

As mentioned, creating the latent electrostatic image in this manner eliminates the necessity of incorporating charge transporting molecules in the surface layer of the device. This provides an additional benefit, as it allows for the surface layer of the imaging member to be selected from a range of dielectric materials so as to minimize wear relative to traditional organic photoreceptors, thus extending the lifetime of the device. In a specific embodiment the dielectric layer 20 comprise a polycarbonate, but in other embodiments, the dielectric layer 20 may comprise any dielectric material, for example, but not limited to, silicate glass, polyepoxide, poly (styrene-block-butadiene-block-styrene), and the like. In embodiments, the dielectric layer 20 has a thickness of from about 1 micron to about 100 microns or from about 20 micron to about 40 microns. In one embodiment, the dielectric layer 20 has a thickness of 30 microns.

The imaging member may further employ an arrangement of electrodes 15 and one or more transistors 30 coupled to one or more pixel pads 25. The arrangement of the electrodes 15 and transistors 30 may be such that they are embedded in the support substrate 10, in a fashion similar to a transistor backplane in a liquid crystal display, and coupled to pixel pads disposed on the substrate surface. Alternately, the arrangement of the driving circuit electrodes 15 and transistors 30 may be such that they are completely separate from the support substrate, such that the pixel pads disposed on the support substrate and are connected to the external electrode/transistor driving circuit via metallic leads.

The size of the pixel pads and separation distance between the pads will to a large extent determine the resolution of the latent electrostatic image and ultimately the printed image that can be created. In one embodiment, a resolution of about 125 dots per inch was achieved with a pixel pad width of 100 um and a separation distance of 100 um, in another embodiment, a resolution of about 300 dots per inch was achieved with a pixel pad width of 40 um and a 40 um separation distance. In other embodiments, better resolution was achieved with a pixel pad width of 10 um and a separation distance of 10 um.

In FIG. 3, there is shown an electrostatic imaging device 35, comprising an electrostatic imaging member 5 and a electrostatic charging device 40, such as a corona charger. The electrostatic imaging member 5 comprises a support substrate 10 having digitally addressable electrodes 15 arranged on the support substrate 10, and a dielectric layer 20 disposed over the digitally addressable electrodes, and wherein the digitally addressable electrodes are patterned on the support substrate in an array of pixels. The ionized gase is attracted 45 to the grounded electrode 15 through the dielectric layer 20.

Figure 5:
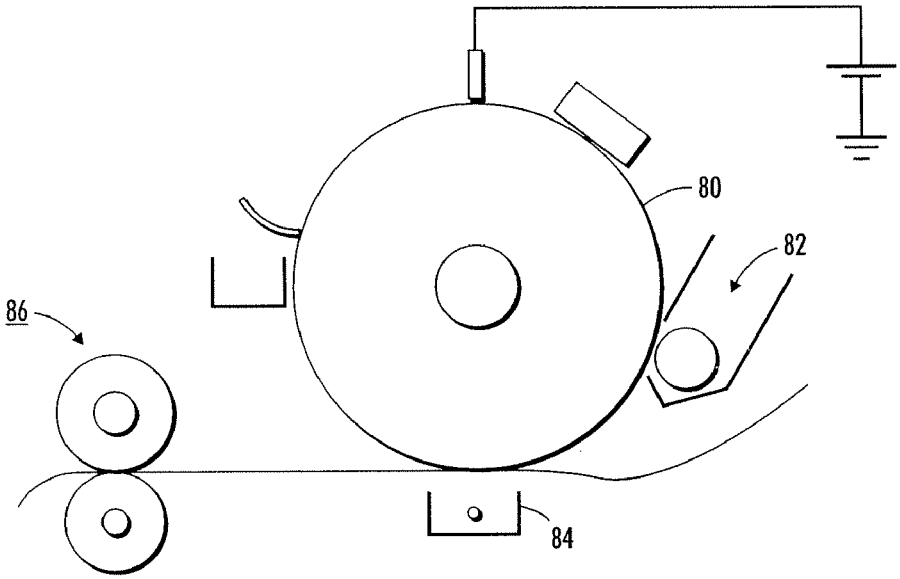
FIG. 5 illustrates an image forming apparaturs comprising an electrostatic imaging member according to the present embodiments.

The electrostatic imaging member can be used in an image forming apparatus. In such embodiments, as shown in FIG. 5, the image forming apparatus comprises the electrostatic imaging member, described above, which has a charge retentive-surface 80 for receiving an electrostatic latent image thereon, a development component 82 for applying a developer material to the charge-retentive surface to develop the electrostatic latent image to form a developed image on the charge-retentive surface, a transfer component 84 for transferring the developed image from the charge-retentive surface to a copy substrate; and a fusing component 86 for fusing the developed image to the copy substrate.

The present embodiments provide various advantages over the conventional photoreceptor-based system. In particular, the formation of electrostatic images is free from photo-induced discharge and charge transport that are inherent with photoreceptor designs. There is also less wear in the present embodiments due to the use of hard dielectric materials (instead of relatively soft charge transport layer consisting of organic semiconductor in polymer binder). Finally, high speed can be achieved due to simultaneous charging and latent image formation rather than imaging via photo-discharge.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limiting Working Examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

Example 1

Prototype Fabrication

The prototype imaging member was fabricated in a similar fashion to the dual layer photoreceptors that Xerox Corporation currently makes. However, lab-based fabrication procedures were employed for the purposes of reduction to practice of the present embodiments.

Silver pixel pads were patterned on to a 5 c×5 cm borosilicate glass substrate by physical vapor deposition through a shadow mask. In total five pixel pads with dimensions of 3 cm×100 um with a 100 um separation distance were disposed side by side on the substrate. From a solution of 1 g polycarbonate in 12 g dichloromethane a 30 μm thick layer of polycarbonate was then blade coated over the electrodes. Care was taken to ensure that the ends of the electrodes were left bare, so that an electrical contact could be made subsequent to the application of the dielectric polycarbonate layer. The coated device was then allowed to dry in air for 1 hour at room temperature and then was heat-treated in an oven at 120° C. for 30 minutes to remove any remaining solvent.

Example 2

Prototype Demonstration

Prints were made with the prototype of Example 1 in a manner similar to what is depicted in FIG. 3. First electrodes on the device were selectively grounded, and then the imaging member was passed under a positive corona emitting corotron (wire biased to about +5000 V). After corotron charging, the grounded electrodes were disconnect from ground, and then the latent electrostatic image was developed by dusting negatively tribo-charged toner with carrier onto the surface of the imaging member. The excess toner and carrier were then removed with a puff of compressed air. There was overdevelopment and carrier noted on the imaging member after development, due to the uncontrolled conditions of the rudimentary development process used in the experiment.

Improvement in the overdevelopment and carrier-bead carryout was observed when the imaging member was run in a modified XEROX DC12 printer. In this case, the imaging member was mounted on a suitable blank drum to which the electrodes could be grounded and then inserted into the DC12 consumer replicable unit (CRU), and then the CRU with the protype drum were inserted in the DC12 printer. Additionally, the corona charger in the printer was modified to emit positive instead of the usual negative corona ionized gas. The resulting print demonstrated the improvement, indicating that the overdevelopment and carrier-bead carryout can be addressed by modifying specific components and parameters of the xerographic engine.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for creating an electrostatic latent image, comprising:

providing an electrostatic imaging member, further comprising a support substrate having individually addressable pixel pads arranged on or in the support substrate, and a dielectric layer disposed over the individually addressable pixel pads;

applying an electrostatic charger to the electrostatic imaging member; and generating an electrostatic image, wherein the electrostatic image is generated in a single step by grounding selected pixel pads in a pattern that is to be printed while applying the electrostatic charger to the surface of the dielectric layer of the electrostatic imaging member and further wherein each pixel pad of the array of pixel pads has a width of 10 um and a separation distance of 10 um.

2. The method of claim 1, wherein the individually addressable pixel pads are patterned on the support substrate in an array.

3. The method of claim 2, wherein the support substrate further comprises one or more transistors coupled to the array of pixel pads.

4. The method of claim 2, wherein the support substrate further comprises an array of transistors disposed over the support substrate with each pixel pad of the array of pixel pads connected to a transistor.

5. The method of claim 2, wherein an electrostatic image is generated by grounding selected pixel pads in a pattern that is to be printed while applying an electrostatic charger to the surface of the dielectric layer of the electrostatic imaging member.

6. The method of claim 1, wherein the dielectric layer has a thickness of from about 1 micron to about 100 microns.

7. An electrostatic imaging device, comprising:

an electrostatic imaging member comprising a support substrate having individually addressable pixel pads arranged on or in the support substrate, and a dielectric layer disposed over the individually addressable pixel pads, wherein the individually addressable pixel pads are patterned on the support substrate in an array and further wherein each pixel pad of the array of pixel pads has a width of 10 um and a separation distance of 10 um; and an electrostatic charging device, wherein an electrostatic image is generated by grounding selected pixel pads in a pattern that is to be printed while applying the electrostatic charger to the surface of the dielectric layer of the electrostatic imaging member.

8. The electrostatic imaging device of claim 7, wherein the support substrate further comprises one or more transistors coupled to the array of pixel pads.

9. The electrostatic imaging device of claim 7, wherein the support substrate further comprises an array of transistors disposed over the support substrate with each pixel pad of the array of pixel pads connected to a transistor.

10. The electrostatic imaging device of claim 7, wherein the electrostatic charge is disposed on the imaging device by an electrostatic charger.

11. The electrostatic imaging device of claim 10, wherein the electrostatic charger is selected from the group consisting of a corotron, scorotron and biased charge roller.

12. The electrostatic imaging device of claim 7, wherein the dielectric layer comprises a polycarbonate.

13. The electrostatic imaging device of claim 7, wherein the dielectric layer has a thickness of from about 1 micron to about 100 microns.

14. The electrostatic imaging device of claim 7, wherein the dielectric layer has a thickness of from about 20 microns to about 40 microns.

15. The electrostatic imaging device of claim 7, wherein each pixel pad of the array of pixel pads has a width of 100 um and a separation distance of 100 um.

16. An image forming apparatus for forming images on a recording medium comprising:

a) an electrostatic imaging device having a charge retentive-surface for receiving an electrostatic latent image thereon, wherein the electrostatic imaging device comprises an electrostatic imaging member comprising a support substrate having individually addressable pixel pads arranged on or in the support substrate, and a dielectric layer disposed over the individually addressable pixel pads, wherein the individually addressable pixel pads are patterned on the support substrate in an array and further wherein each pixel pad of the array of pixel pads has a width of 10 um and a separation distance of 10 um; and an electrostatic charging device, wherein an electrostatic image is generated by grounding selected pixels pads in a pattern that is to be printed while applying the electrostatic charger to the surface of the dielectric layer of the electrostatic imaging member;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

17. The image-forming apparatus of claim 16, wherein the support substrate further comprises one or more transistors coupled to one or more pixel pads of the array of pixel pads.

18. The image-forming apparatus of claim 16, wherein the electrostatic charge is disposed on the imaging device by an electrostatic charger.

19. The image-forming apparatus of claim 18, wherein the electrostatic charger is selected from the group consisting of a corotron, scorotron and biased charge roller.

* * * * *